US005716084A

United States Patent [19]

Sanford, Jr. et al.

[11] Patent Number: 5,716,084

[45] Date of Patent: Feb. 10, 1998

[54] DOOR SECURITY SYSTEM

[76] Inventors: Jack G. Sanford, Jr., 226 N. 1st St., Campbell, Calif. 95008; Jack G. Sanford, Sr., 301 California, Columbus, Kans. 66725

[21] Appl. No.: 690,114

[22] Filed: Jul. 31, 1996

[51] Int. Cl.[6] ..... E05C 17/36

[52] U.S. Cl. ..... 292/264; 292/246

[58] Field of Search ..... 292/264, 246, 292/248; 70/14, 18, 30, 49

[56] References Cited

U.S. PATENT DOCUMENTS

| | | | |
|---|---|---|---|
| 186,319 | 1/1877 | Dietz | 292/264 |
| 878,607 | 2/1908 | Cairns | 292/264 |
| 3,798,934 | 3/1974 | Wright et al. | 70/18 |
| 3,804,454 | 4/1974 | Simmons | 292/246 |
| 3,809,418 | 5/1974 | Canfield | 292/264 |
| 3,853,343 | 12/1974 | Hunter | 292/264 |
| 4,155,577 | 5/1979 | Raymond | 292/264 |
| 4,478,442 | 10/1984 | Martin | 292/246 |
| 4,560,191 | 12/1985 | Grassi | 292/264 |
| 5,181,402 | 1/1993 | Faessler et al. | 70/18 |
| 5,465,595 | 11/1995 | Sheppard | 292/264 |
| 5,466,022 | 11/1995 | Derman | 292/264 |

FOREIGN PATENT DOCUMENTS

| | | | |
|---|---|---|---|
| 1155157 | 6/1969 | United Kingdom | 292/264 |
| 2187498 | 9/1987 | United Kingdom | 292/264 |

*Primary Examiner*—Rodney M. Lindsey

*Attorney, Agent, or Firm*—Patrick T. Reilly; Carol D. Titus; Gregory S. Smith

[57] ABSTRACT

A multi-position door security system that provides a primary locked position keeping a closed door secure and also providing varying degrees of secure openings to allow a user to see outside or accept envelopes and packages through an opening. The invention is formed of a cable and a locking bracket which is attached to the frame of the house. The cable is looped and secured around a door knob and is then passed through one or two keyway openings in the locking bracket. One or more locking fitting are rigidly attached to the cable. The locking fittings are sized such that they do not fit through the openings of the locking bracket. This allows the user to choose how far the door will open by choosing which of the locking fittings engage the locking bracket. The invention also allows for easy disengagement by the user in case of fire or emergency. Because of the design and materials used in construction, the invention is secure, economical and easy to install. The present invention is used to secure swinging and sliding doors.

19 Claims, 8 Drawing Sheets

DOOR SECURITY SYSTEM

FIELD OF THE INVENTION

This invention relates to securing and locking mechanisms for doors located within frames, walls or buildings, and in particular, to mechanisms comprising a cable or chain and using a door knob or door handle as one anchor point.

BACKGROUND OF THE INVENTION

The frequency with which burglary and other crimes against property presently occur within the United States of America has created a significant public interest in methods and means to economically protect the physical security of buildings, rooms located within buildings, and secured areas protected by fence structures and/or free standing walls.

Local law enforcement agencies are becoming increasingly overloaded with calls to respond to various crimes, which unavoidably lengthens their average response time. This delay in response time often allows sufficient time for an efficient burglar to effectively loot a protected area, such as a home or a storeyard.

In general, an experienced burglar requires no more than five minutes to break in grab his fill and depart. The locking device or devices placed on doors are typically the most significant obstacle a burglar must quickly defeat in order to minimize his exposure time.

Burglars have consistently found ways to circumvent even the most cunning locking devices. The impetus behind this invention is to prevent a robbery in its most crucial stage: the intrusion. Thieves have learned to pick key locks and use brute force to overpower chain locks. The present invention means to prevent entry to a would-be robber by denying him access and opportunity to defeat said invention. The integrity of the invention would be such that it would withstand the efforts of a potential intruder while maintaining uncomplicated operation so as not to create safety hazards for the user.

To date, most prior art has utilized a flexible securement member and two anchor points, one affixed to the door itself, the other, to an adjacent wall. U.S. Pat. No. 4,548,060 by Campbell describes a system wherein an armored cable is permanently anchored to the side of a vending machine while the opposite end is interlocked with a stationary member on the front of the machine. This device relies entirely on the integrity of the locking cylinder and its resistance to being picked by a robber.

More common in home usage are chain-lock devices comprising an anchor point mounted to the door frame, a flexible chain and a third element mounted to the door itself. This element has an elongated horizontal slot to receive the loose end of the chain. When the door is opened a few inches, the chain is pulled taught. This allows the occupant to see who is at the door without relinquishing the safety of a locked barrier door. Though in wide usage, this system is easily defeated. Most exterior door frames have cosmetic trim laminate on the exterior surface and a core filler which is many times particle board or other manufactured filler—hardly a sound structure for holding wood screws securely. With a sharp blow to the door, the anchor point is ripped from its location as the door frame is shattered.

When no occupant is present, the device is even more vulnerable. A robber can simply insert a thin metal object between the door and its frame to loose the chain from its slot. However, the device's most basic failing is that its first point of restraint occurs after the door has been opened several inches. This gives the potential intruder access to the security system. By manipulation or cutting of the chain, the robber can easily defeat the system.

There exists a system similar to the chain lock though much heavier and stronger. The system comprises a bar with a knob at the end mounted to the door. The bar extends about an inch past the edge of the door. A hinged U-shaped receptacle is mounted to the door frame. A wide section at the base allows the bar passage through when the door is closed. When opened with the bar and receptacle interlocked, the door swings open until the bar reaches the closed end of the U-shaped receptacle.

This system is more resistant to force than the chain lock. However, since part of the device is mounted on the door frame, it is susceptible to the robber lunging at the door. Or, the device can be rendered inoperative with the use of a thin metal tool or long screwdriver to manipulate the U-receptacle off the bar. As with the chain lock, this system restrains the door only after it has been opened several inches. Once in this position, the robber can defeat the system by manipulation or cutting.

To alleviate these problems of structural integrity of both door and door frame, U.S. Pat. No. 5,466,022 by Derman sought to employ the strongest element in the immediate area: the door knob. This system comprises an anchor member, a plastic-coated wire cable, a lag bolt and a bushing. The anchor member containing the bushing is mounted to the door frame by the lag bolt. The ends of the cable pass through holes in the anchor member, past the bushing that angles the ends. When the door is opened, tension is put on the cable causing the edges of the holes in the anchor member to bite into the angled cable ends.

Because the system has incorporated the door knob, it is quite resilient when the robber lunges at or kicks the door. Still, the system is exposed when drawn taught by opening the door. The cable can then be cut.

In the event that the occupant must exit a home or building quickly, the release action of the chain lock, U-receptacle and cable loop systems can inhibit an expedient exit. In a crisis situation, when seconds count or a panicking occupant is carrying a child or burdened with valuable material, precious time lost while releasing a door security system, at best this is inconvenient, and at worst it is life threatening.

U.S. Pat. 4,472,143 by Bennett et at. attempts to address this concern. It employs a door-frame anchor point and flexible chain like the aforementioned systems. Instead of a hinged or slotted receptacle mounted to the door, it uses a pivotal handle to secure the end of the chain. Though the device provides for emergency release, it is just as susceptible to manipulation, cutting or a sharp blow as are the aforementioned prior art examples.

In view of these systems' shortcomings, it is apparent that there is a dear and present need for a sturdy yet safe security system that denies a would-be burglar access to the system and thus entry to a secured area, but is also easily freed in case of emergency.

SUMMARY OF THE INVENTION

The present invention provides a door security device that can be attached to the two most structurally sound anchor points in the area of a door: the door knob and a frame member of a building, house or free standing wall. The system provided by the present invention comprises a cable affixed around a door knob or door handle; a locking bracket mounted to a frame member of a building, house or free standing wall; and a locking fitting and is secure, safe and easy to install.

In the event the key lock of a door, door handle or door knob is picked, the invention prevents a door from being opened at all. Thus, the system will not allow a potential intruder access to the device. It is resistant to "jimmying" with a thin metal tool since the system is taught even when a door is closed. In addition, certain preferred embodiments give the user varying degrees to which a door can be opened as well as a quick release in case of emergency.

Thus, it is an object of this invention to provide a secure means of locking a door of a building, wall, fence or other physical structure.

Certain preferred embodiments employ a locking bracket mounted to a building or structural frame member located adjacent to the door frame rather than the door frame itself, which is usually thin and easily shattered. When in a locked position, embodiments of this type will hold the door shut and deny access to the system from outside the door while also providing a single-action release in case immediate evacuation of the building is necessary.

Certain alternate preferred embodiments also provide a secondary position in which the user can see who is at the door while remaining secure.

Certain alternate preferred embodiments provide a plurality of secured positions which enable an occupant to select the degree to which the door is opened, so that objects of various sizes may be passed through the doorway while reducing the risk of forced entry.

The foregoing and other objects and advantages of this invention will become apparent to those skilled in the art upon reading the description of a preferred embodiment which follows in conjunction with a review of the appended drawings.

DESCRIPTION OF A PREFERRED EMBODIMENT

The disclosure presented herein is illustrative only and not limiting. In light of the following disclosure, alternate preferred embodiments of the present invention will be obvious to one skilled in the art.

Figure 1:
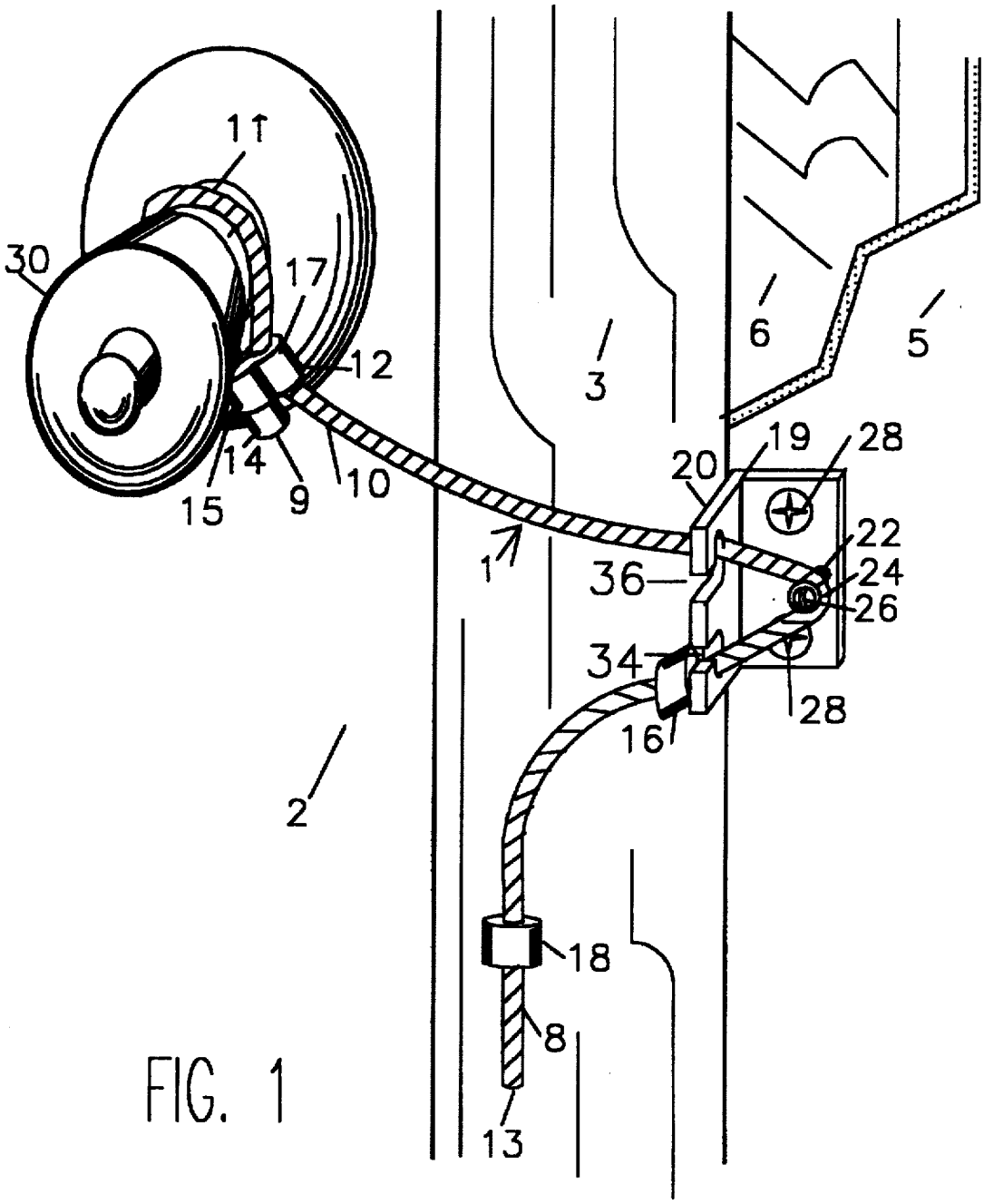
FIG. 1 shows the door security system in place on the inside of a door of a building.

Referring particularly to the drawings, there is shown in FIG. 1 a door security device 1 comprising a cable 10, a locking bracket 20 and first and second locking fittings 16 and 18. Certain preferred embodiments of the present invention comprise only a first locking fitting 16 without additional locking fittings 18, and certain alternate preferred embodiments of the present invention comprise a plurality of second locking fittings 18.

FIG. 1 further discloses a preferred embodiment of the present invention installed on door 2. Cable 10 comprises a first end 9, a second end 13, a tail 8 and a loop 11 and is preferably formed of a metal cabling, but other sturdy durable materials may be used. Cable 10 passes through a first channel 15 and a second channel 17 of slip fitting 12. In certain preferred embodiments of the present invention cable 10 slides freely through one or both channels 15 and 17. In certain alternate preferred embodiments of the present invention cable 10 is inhibited from passing easily through either one or both channels 15 and 17.

Cable end stop fitting 14 is affixed to first end 9 of cable 10 and prohibits the free passage of first end 9 through first channel 15 of slip fitting 12.

Loop 11 of cable 10 is located around door knob 30 of door 2. Loop 11 is comprised of the continuous length of cable 10 extending from first end 9 to second channel 17.

Loop 11 is drawn tight around the door knob 30 so that slip fitting 12 is secure against door knob 30 and cable end stop fining 14 is secure against first channel 15 of slip fitting 12.

Locking bracket 20 has been attached to a building frame member 6 of a building wall 5. The preferred embodiment of the present invention attaches to structural framing to ensure a significant amount strength; however, the bracket may be attached to any physical structure. The bracket may, in certain embodiments of the present invention, be attached to the door trim 3 or other superficial decor. This type of embodiment of the present invention does not provide the same strength as one of the framing members 6 of the building 5, but still provides better security than a standard lock. Locking bracket 20 is comprised of a piece of metal bent 90 degrees down its centerline 19 with a right-hand keyway 36, a left-hand keyway 34, two locking bracket mounting screws 28, a locking post 22, a washer 24 and a locking post machine screw 26. Two locking bracket mounting screws 28 are used to attach locking bracket 20 to the building frame member 6. Right-hand keyway 36 and left-hand keyway 34 are cut in opposing "L" shapes as to allow cable 10 to pass through locking bracket 20, around locking post 22 and under washer 24 while preventing either first locking fitting 16 or second locking fitting 18 from doing so, thus, securing the system. The locking post 22 may be a part of the screw 26, may be welded to the screw 26, or omitted entirely. However, it is preferred to have a smooth surface against which the cable 10 rests in order to prevent the cable from being damaged.

The second end 13 of cable 10 has been placed in the locked position by placing cable 10 through right-hand keyway 36, around locking post 22, under washer 24 and through left-hand keyway 34. First locking fitting 16 is tight against the door-side of left-hand keyway 34.

Figure 2:
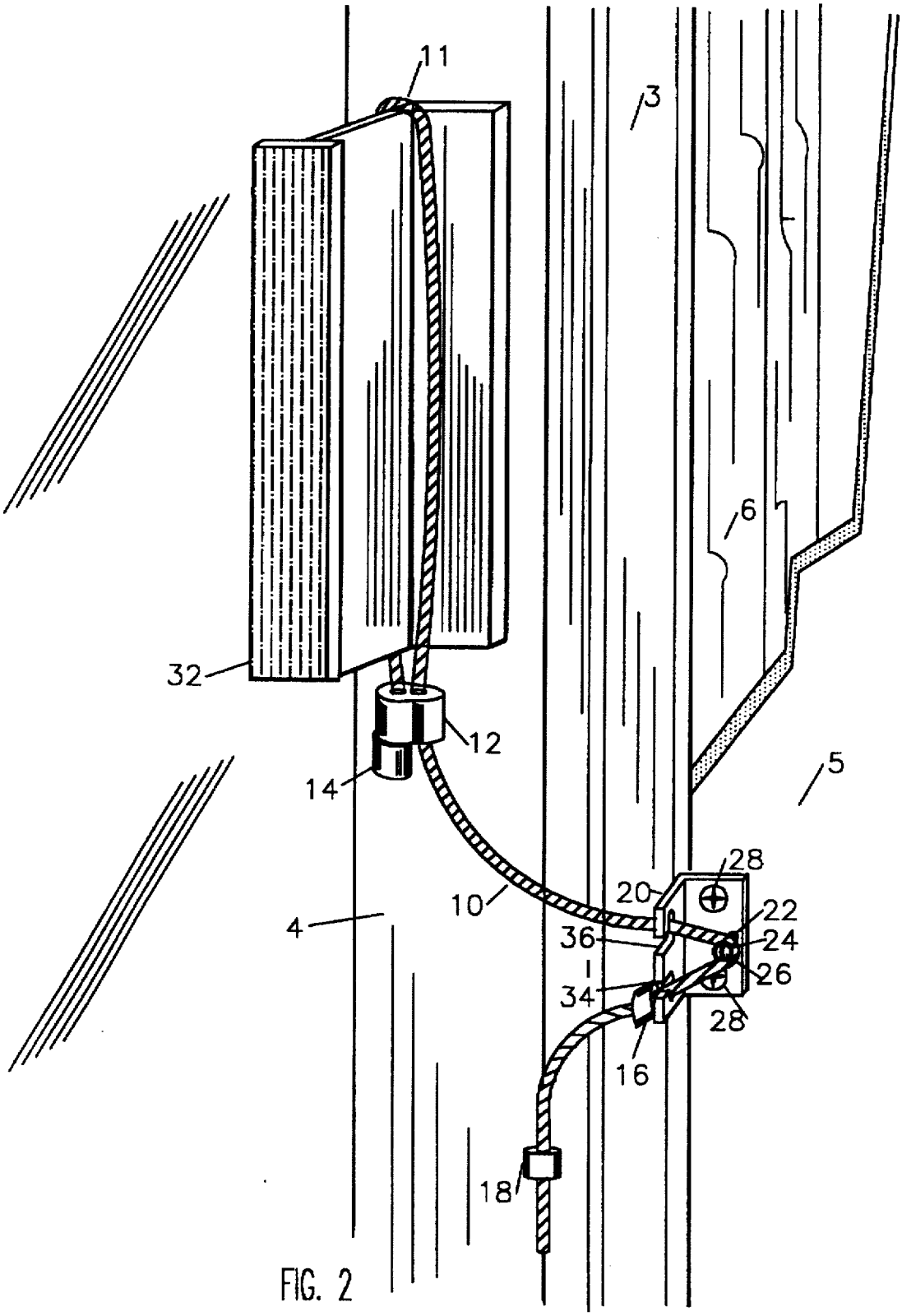
FIG. 2 shows the door security system in place on the inside of a sliding door of a building.

FIG. 2 shows the invention installed on sliding door 4 of a building. Referring in detail to FIG. 2, loop 11 of cable 10 is passed over sliding door handle 32 of sliding door 4. Loop 11 is comprised of cable 10, a slip fitting 12 and a cable-end stop fitting 14. The loop 11 is drawn tight around sliding door handle 32 so that slip fitting 12 is secure against sliding door handle 32 and cable end stop fitting 14 is secure against slip fitting 12. Locking bracket 20 has been attached to a building frame member 6 of a building wall 5. Locking bracket 20 is comprised of a piece of metal bent 90 degrees down its centerline with a right-hand keyway 36, a left-hand keyway 34, two locking bracket mounting screws 28, a locking post 22, a washer 24 and a locking post machine screw 26. Two locking bracket mounting screws 28 are used to attach locking bracket 20 to the building frame member 6. Right-hand keyway 36 and left-hand keyway 34 are cut in opposing "L" shapes as to allow cable 10 to pass through locking bracket 20, around locking post 22 and under washer 24 while preventing either first locking fitting 16 or second locking fitting 18 from doing so, thus, securing the system. The opposing end of cable 10 has been placed in the locked position by placing cable 10 through right-hand keyway 36, around locking post 22, under washer 24 and through left-hand keyway 34. First locking fitting 16 is tight against the door-side of left-hand keyway 34.

Figure 3:
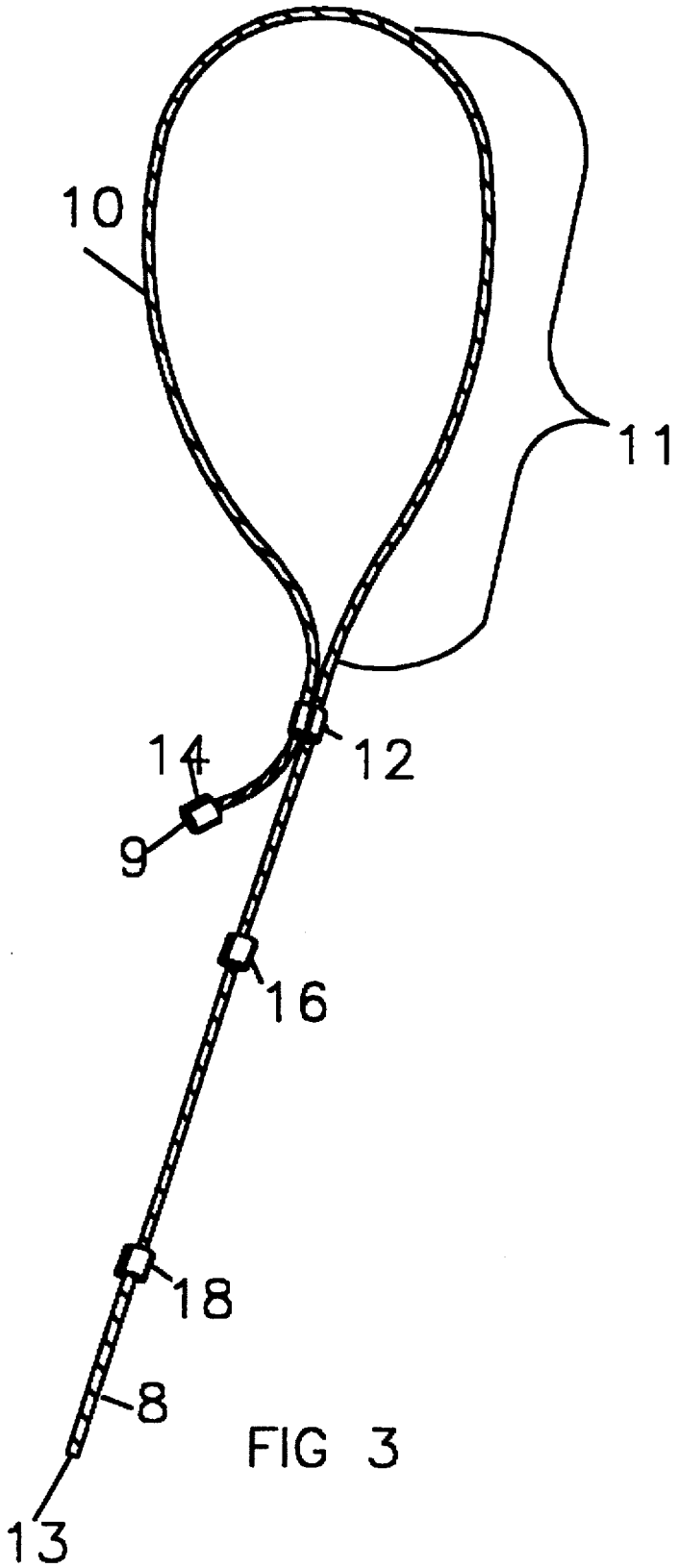
FIG. 3 shows the locking cable assembly and the placement of the locking fittings along the cable.

FIG. 3 clearly illustrates the assembly of cable 10. As mentioned above, cable 10 comprises first end 9, second end 13, loop 11 and tail 8. First end 9 and second end 13 are passed through slip fitting 12 so as to form loop 11. Cable-end stop fitting 14 is affixed to first end 9. In this preferred embodiment, tail 8 comprises a two-inch segment of cable 10.

A second locking fitting 18 is attached roughly two inches from the second end 13. Tail 8 comprises a two inch segment of cable 10 located between second locking fitting 18 and second end 13. A first locking fitting 16 is affixed to cable 10 approximately three inches from the second locking fitting 18.

Certain preferred embodiments of the present invention comprise a multiplicity of second locking fittings 18. In preferred embodiments of this type, tail 8 is defined as the length of cable 10 extending from the first locking fitting 16 to the second end 13.

Certain alternate preferred embodiments of the present invention comprise a multiplicity of second locking fittings 18. In certain preferred embodiments of the present invention of this type, tail 8 is defined as the length of cable extending from the second end 13 to the specific second locking fitting 18 located the shortest distance from second end 13 and along the length of cable 10.

Figure 4:
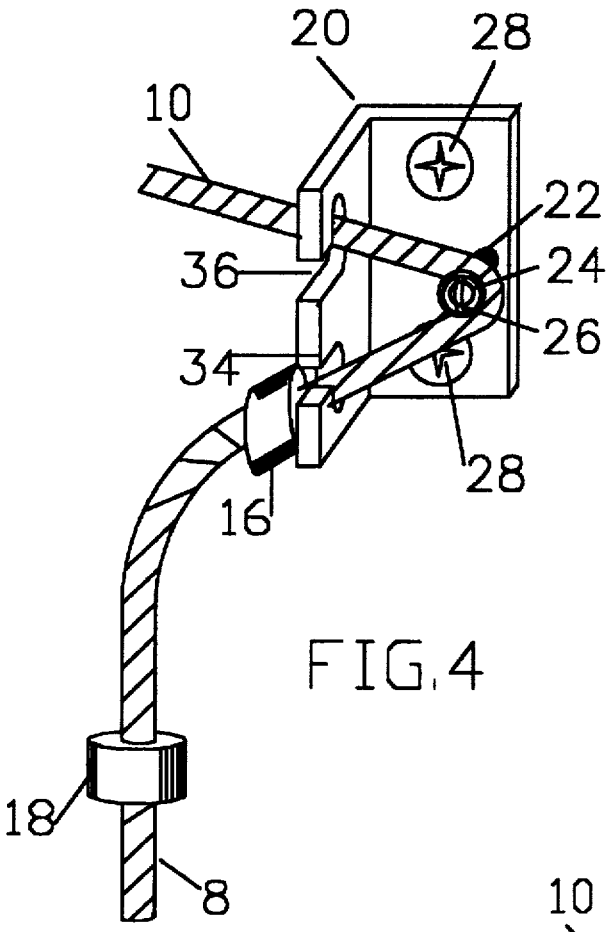
FIG. 4 is a view of the bracket and locking post with the cable in the locked position.

FIG. 4 illustrates a preferred embodiment of the present invention in a locked position. Locking bracket 20 has been attached to a building frame member 6 of building wall 5 via two locking bracket mounting screws 28. Loop 11 has been secured to a door knob 30 or a sliding door handle 32 (not shown) and drawn taught as per FIGS. 1 and 2. Cable 10 is passed through right-hand keyway 36. It is placed around locking post 22 and under washer 24, both of which are affixed to locking bracket 20 by a locking bracket machine screw 26. Cable 10 is then passed through left-hand keyway 34 so that first locking fitting 16 rests against the door-side of locking bracket 20. This is the primary locked position whereby door 2 or sliding door 4 is immobilized.

Certain alternate preferred embodiments do not require locking post 22, washer 24 or locking bracket machine screw 2,6. In its most basic form the present invention has only a locking bracket 20 attached to a secure structure. The bracket 20 need only have a single keyway, either left- or right-hand. For further security, a second, opposing keyway may be added.

Figure 5:
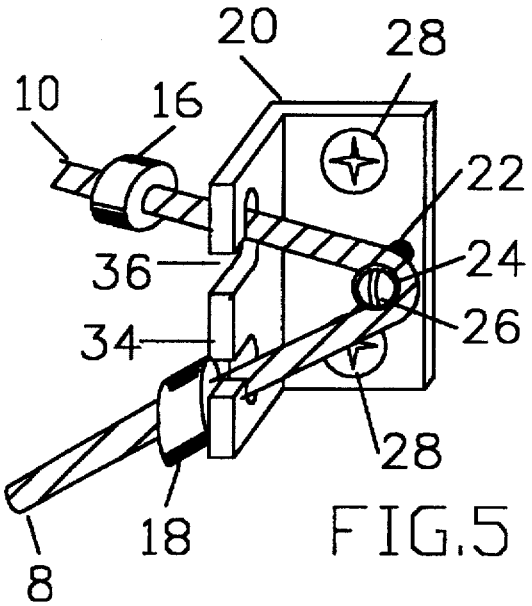
FIG. 5 shows bracket, locking post and cable locked in a secondary position which allows partial opening of the door.

FIG. 5 shows the invention in a secondary locking position allowing door 2 or sliding door 4 to be opened several inches without relinquishing the security of the system. Loop 11 has been secured to door knob 30 or sliding door handle 32 (not shown) and drawn taught. Cable 10 is passed through right-hand keyway 36, around locking post 22, under washer 24 and through left-hand keyway 34. Second locking fitting 18 is placed against the door-side of locking bracket 20. This position allows for some slack in cable 10 between door knob 30 or sliding door handle 32 and locking bracket 20. The system is still secure as the door 30 is slightly opened to see who is outside.

Figure 6:
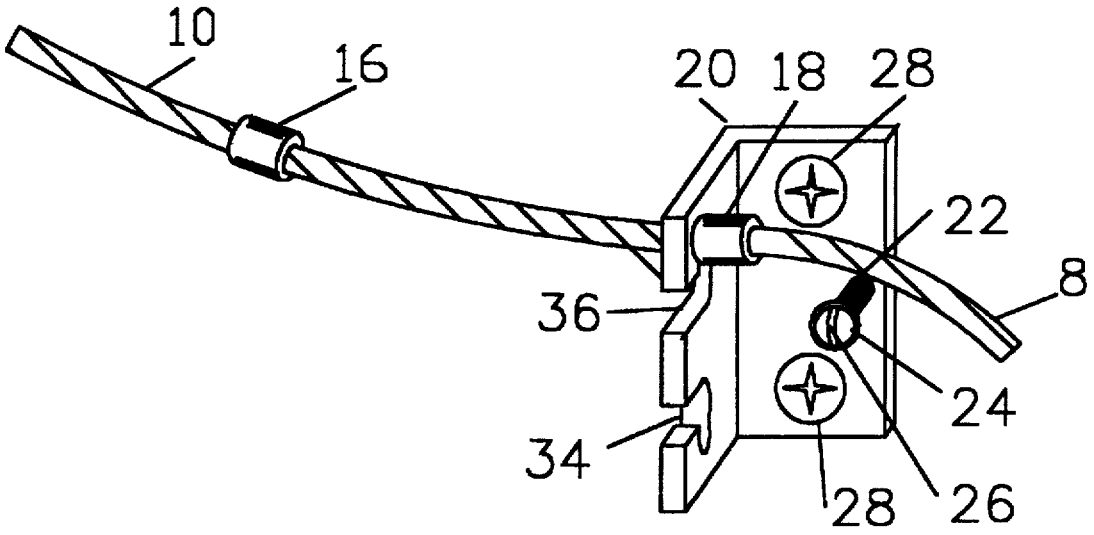
FIG. 6 shows another position at which the system may be locked to allow even greater opening of the door.

Please note that certain alternate preferred embodiments of the present invention comprise only a singular right-hand keyway 36 or a singular left-hand keyway 34 and not FIG. 6 shows another secure position in which door 2 or sliding door 4 can be opened to a greater degree. In this position, an envelope or small package may be passed through the opening while still keeping door 2 or sliding door 4 secure. Loop 11 has been secured to door knob 30 or sliding door handle 32 (not shown) and drawn taught. Cable 10 is passed through right-hand keyway 36. Second locking fitting 18 rests on the wall-side of locking bracket 20, against right-hand keyway 36. FIG. 6 discloses a state of the invention where a greater opening of door 2 (or sliding door 4) is allowed while still providing physical security to the occupant.

The quick release action of the present invention is accomplished by moving cable 10 out of and away from right-hand keyway 36 and left-hand keyway 34 of locking bracket 20. This is typically accomplished by gasping and pulling tail 8. The tail 8 is then manipulated to remove the cable from the keyways. For example, if the cable of FIG. 1 were being removed, the tail 8 would be pulled taught, moved slightly upward and pulled out of the lower keyway 34. Then, the cable would be unwrapped from the locking post 22, pulled slightly downward and out of the upper keyway 36. At this point the door is free and may be opened at the user's discretion. In use this removal takes little more time than opening a door with no security device, while providing a significantly more secure environment.

Figure 7:
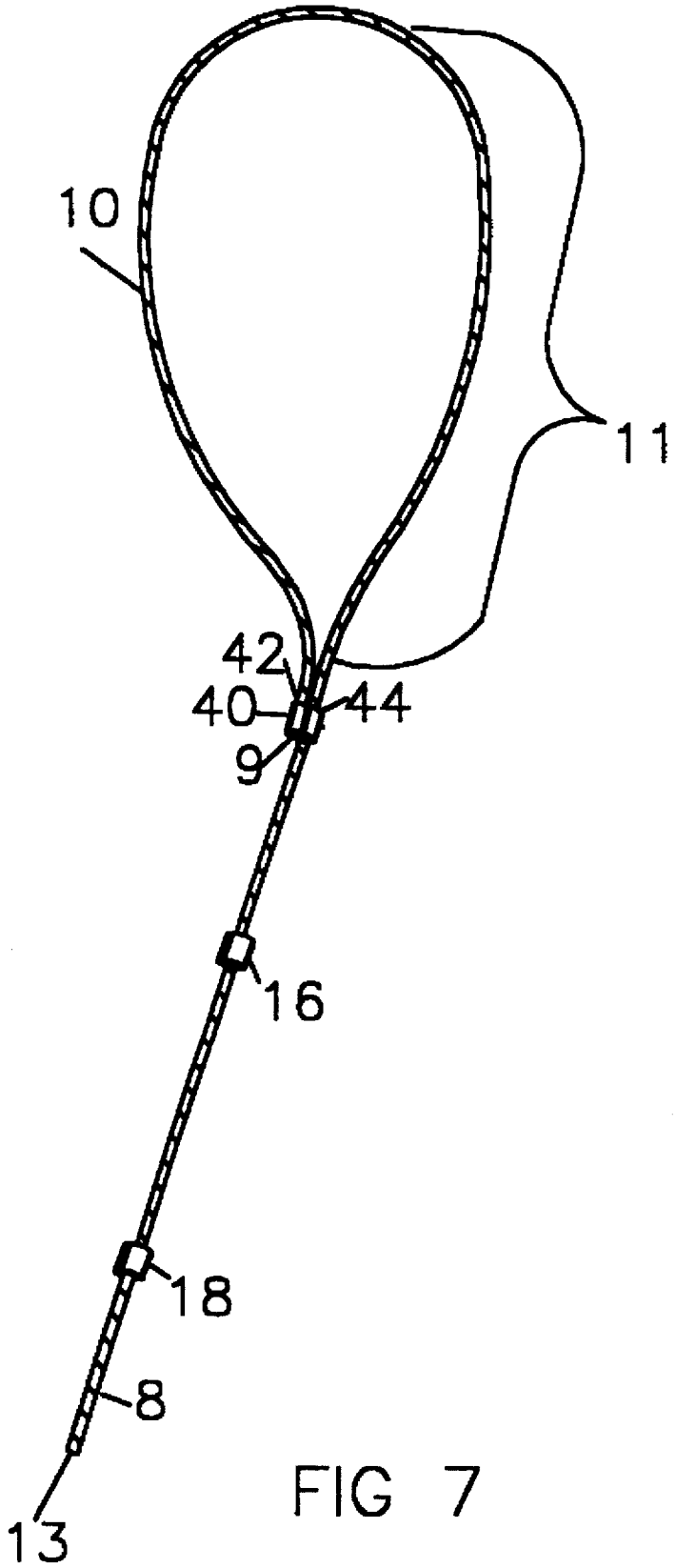
FIG. 7 is a view of an alternate version of one end of the cable of the present invention.

Referring now to FIG. 7, an alternate configuration of the first end of the cable 10 is shown. A simplified slip fitting 40 is connected to cable 10 and is comprised of an attachment point 42 and a single channel 44. The first end 9 of cable 10 is affixed to simplified slip fitting 40 at attachment point 42. Cable 10 then leads from attachment point 42 as loop 11 and into single channel 44. Cable 10 slides freely through single channel 44 in certain preferred embodiments of the present invention, and is inhibited from sliding by various degrees in various alternate preferred embodiments of the present invention.

Figure 8:
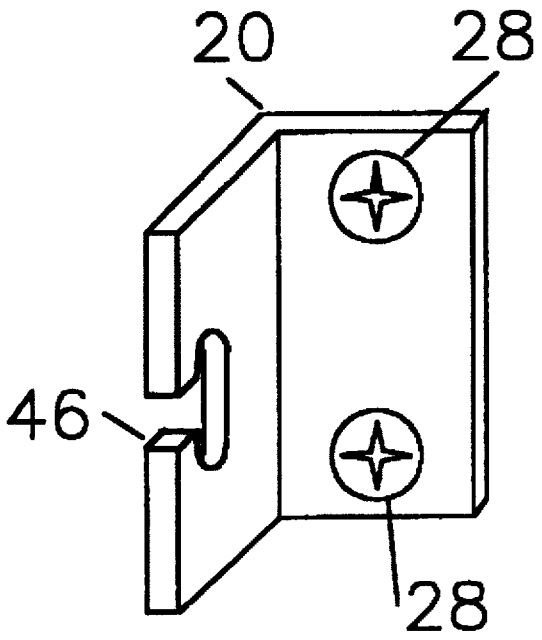
FIG. 8 illustrates a locking bracket comprising a single "T" shaped keyway.

FIG. 8 illustrates a locking bracket 20 as including a single T-shaped keyway 46. Alternate preferred embodiments of the present invention which comprise single and multiple T-shaped keyways 46 are used with swing doors that swing inwards and/or outwards, with swing doors that are hinged on either side and with sliding doors.

Figure 9:
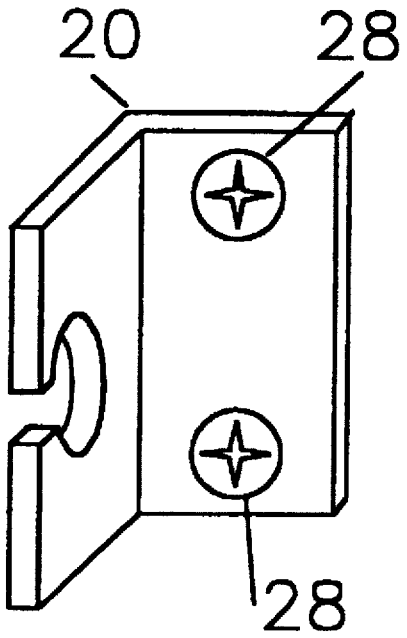
FIG. 9 illustrates a locking bracket comprising a single keyway which includes a rounded through hole.

Referring now to FIG. 9, a locking bracket 20 is shown to include a single rounded keyway 48. Alternate preferred embodiments of the present invention which comprise single and multiple rounded keyways 48 are used with swing doors that swing inwards and/or outwards, with swing doors that are hinged on either side and with sliding doors. Several of the preferred embodiments of the present invention as shown in FIGS. 1, 8, and 9 are symmetrical from top to bottom. This type of design is preferred in situation where only a single bracket 20 will be manufactured. The symmetrical brackets 20 allow the user to place the bracket 20 on either the left or the right side of the door 2 (depending on the hinge location), on sliding doors 4, and virtually any other situation. In cases where manufacturing is not as much of a concern, a left-hand keyway 34 bracket 20 and a right-hand keyway 36 bracket 20 may be manufactured.

What is claimed is:

1. A door security system for a knob or handle operated door mounted onto a physical structure, said door security system comprising:

(a) a cable, said cable comprising a first end, a second end, a tail and a loop segment;

(b) a cable end stop fitting, said cable end stop fitting attached to said first end;

(c) a slip fitting, said slip fitting comprising a first channel and a second channel, and said cable passing through and slidable in both said first channel and said second channel;

(d) said loop segment being a length of said cable located between said first channel and said second channel, whereby said loop segment is placed around the knob or the handle of the door;

(e) said cable end stop fitting inhibiting the passage of said first end through said slip fitting;

(f) a locking fitting, attached to said cable and located between said loop segment and said tail; and (g) a locking bracket comprising a keyway, said locking bracket for being affixed to the physical structure, wherein said cable is placed into said keyway and said locking fitting prohibits the sliding passage of said locking fitting through said keyway in the direction of motion of the cable that increases the degree to which the door can be opened.

2. The door security system of claim 1 wherein said cable can be pulled out of said keyway by grasping, pulling and manipulating said tail, whereby the door security system is released and the door is free to open.

3. The door security system of claim 2 further comprising a plurality of said locking fittings attached to said cable.

4. The door security system of claim 1 further comprising a second keyway located in said locking bracket, wherein said cable is placeable into said second keyway.

5. The door security system of claim 4 wherein said first keyway and said second keyway are L-shaped and point in opposing directions.

6. The door security system of claim 4 wherein said locking bracket further comprises a locking post, said cable being wrapable around said locking post.

7. The door security system of claim 4 further comprising a plurality of said locking fittings attached to said cable.

8. The door security system of claim 1 further comprising a plurality of said locking fittings attached to said cable.

9. The door security system of claim 1 wherein said keyway is T- shaped.

10. The door security system of claim 1 wherein said keyway is round.

11. A door security system for a knob or handle operated door mounted into a physical structure, said door security system comprising;

(a) a cable, said cable comprising a first end, a second end, a tail and a loop segment;

(b) a slip fitting, said slip fitting comprising an attachment point and a cable channel, said first end of said cable attached to said slip fitting at said attachment point, and said cable passing through and slidable in said cable channel;

(c) said loop segment being a length of said cable located between said first end and said cable channel, whereby said loop segment is for being placed around the knob or the handle of the door;, (d) a locking fitting, attached to said cable and located between said loop segment and said tail; and (e) a locking bracket comprising a keyway, said locking bracket for being affixed to the physical structure, wherein said cable is placed into said keyway and said locking fitting prohibits the sliding passage of said locking fitting through said keyway in the direction of motion of the cable that increases the degree to which the door can be opened, and where said cable can be pulled out of said keyway by grasping and pulling said tail, whereby said door security system is released and the door is free to open.

12. The door security system of claim 11 further comprising a second keyway located in said locking bracket, wherein said cable is placed into said second keyway.

13. The door security system of claim 12 wherein said first keyway and said second keyway are L-shaped and point in opposing directions.

14. The door security system of claim 13 further comprising a plurality of said locking fittings attached to said cable.

15. The door security system of claim 12 wherein said locking bracket further comprises a locking post.

16. The door security system of claim 12 further comprising a plurality of said locking fittings attached to said cable.

17. The door security system of claim 11 further comprising a plurality of said locking fittings attached to said cable.

18. The door security system of claim 11 wherein said keyway is T- shaped.

19. The door security system of claim 11 wherein said keyway is round.

* * * * *